US012163298B1

(12) United States Patent
Burns

(10) Patent No.: US 12,163,298 B1
(45) Date of Patent: Dec. 10, 2024

(54) PET WASTE COLLECTION DEVICE

(71) Applicant: Donald Burns, Newark, DE (US)

(72) Inventor: Donald Burns, Newark, DE (US)

( * ) Notice: Subject to any disclaimer, the term of this patent is extended or adjusted under 35 U.S.C. 154(b) by 0 days.

(21) Appl. No.: 18/587,946

(22) Filed: Feb. 26, 2024

(51) Int. Cl.
*E01H 1/12* (2006.01)

(52) U.S. Cl.
CPC ..... *E01H 1/1206* (2013.01)

(58) Field of Classification Search
CPC ..... E01H 1/1206
See application file for complete search history.

(56) References Cited

U.S. PATENT DOCUMENTS

| | | | | |
|---|---|---|---|---|
| 2,421,740 | A * | 6/1947 | Birch, Jr. | B65B 67/12 248/101 |
| 4,852,924 | A * | 8/1989 | Ines | A01K 23/005 294/1.5 |
| 7,631,910 | B2 * | 12/2009 | Shalhoub | A01K 23/005 294/1.5 |
| 8,123,266 | B1 * | 2/2012 | Jone | A01K 23/005 294/1.4 |
| 8,177,270 | B2 * | 5/2012 | Chen | A01K 23/005 294/1.4 |
| 9,420,762 | B2 * | 8/2016 | Brasuel | A01K 23/005 |
| 10,455,812 | B1 * | 10/2019 | Bircher | A01K 23/005 |

* cited by examiner

*Primary Examiner* — Stephen A Vu
(74) *Attorney, Agent, or Firm* — Cygnet IP Law; Stephen W. Aycock, II

(57) ABSTRACT

A pet waste collection device is described. The pet waste collection device includes a handle and a bag holder.

6 Claims, 3 Drawing Sheets

PET WASTE COLLECTION DEVICE

FIELD

Some implementations relate generally to pet waste handling devices, and, more particularly, to a pet waste collection device.

BACKGROUND

Pet owners often have to pick up solid pet waste in accordance with municipal ordinances, neighborhood rules, or simply to keep one's property or the property of others sanitary. Often, pet owners wait until their dog or other pet has relieved itself of solid waste and then the owner picks up the solid waste by hand, for example, with a plastic bag covering the hand. A need may exist for a pet waste collection device that would enable a pet owner to retrieve the pet waste before the waste is deposited on the ground and without having to place a hand in a plastic bag and pick the waste up by hand.

Embodiments were conceived in light of the above-mentioned problems and limitations, among other things. The background description provided herein is for the purpose of generally presenting the context of the disclosure. Work of the presently named inventor(s), to the extent it is described in this background section, as well as aspects of the description that may not otherwise qualify as prior art at the time of filing, are neither expressly nor impliedly admitted as prior art against the present disclosure.

SUMMARY

Some implementations can include a pet waste collection device comprising a handle having a hand grip on a first end and a first hinge portion on a second end and a bag holder. The bag holder can include a base including a first rounded end having a first radius and a second rounded end having a second radius, where the second radius is larger than the first radius, a second hinge portion disposed at the second rounded end of the base configured to engaged the first hinge portion of the handle, and a bag latch coupled to the base via a flexible hinge disposed at the second rounded end of the base.

In some implementations, the bag holder is configured to retain a bag when the bag is placed within an interior aperture defined by the bag holder and the bag latch is closed over an upper edge of the bag.

In some implementations, the first hinge portion and the second hinge portion are coupled with a fastener so as to permit the first hinge portion and the second hinge portion to rotate relative to each other. In some implementations, the handle is formed of plastic. In some implementations, the bag holder is made of plastic. In some implementations, the handle is formed of metal. In some implementations, the bag holder is formed of metal.

DETAILED DESCRIPTION

Figure 1:
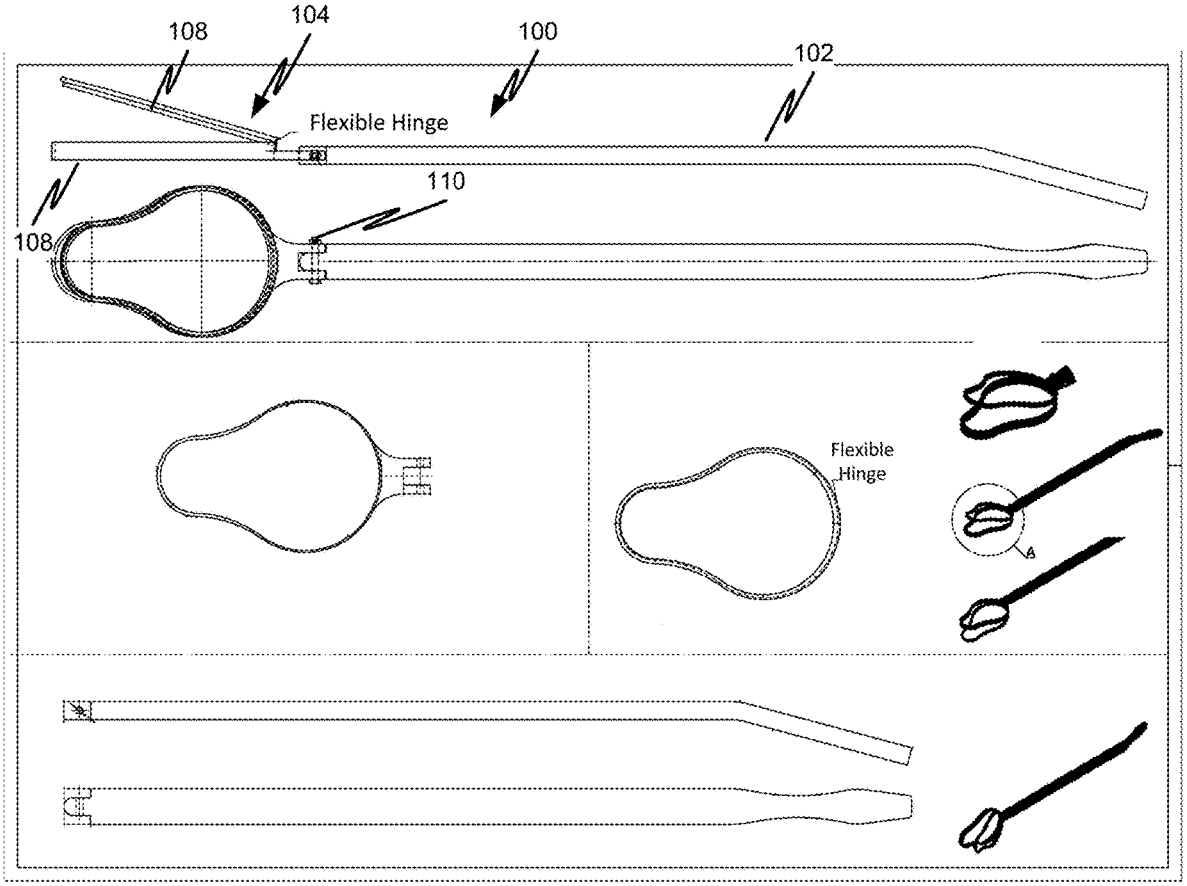
FIG. 1 is a diagram showing various views of an example pet waste collection device in accordance with some implementations.
Figure 2:
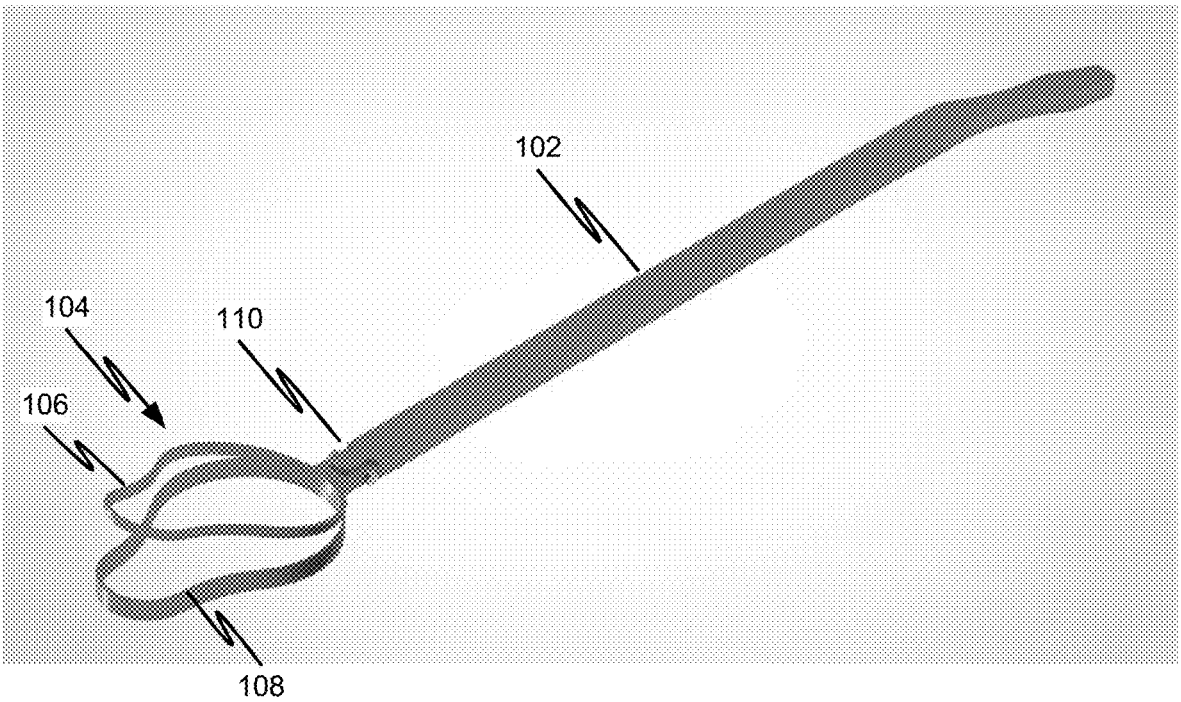
FIG. 2 is a diagram showing a rendering of the example pet waste collection device in accordance with some implementations.
Figure 3:
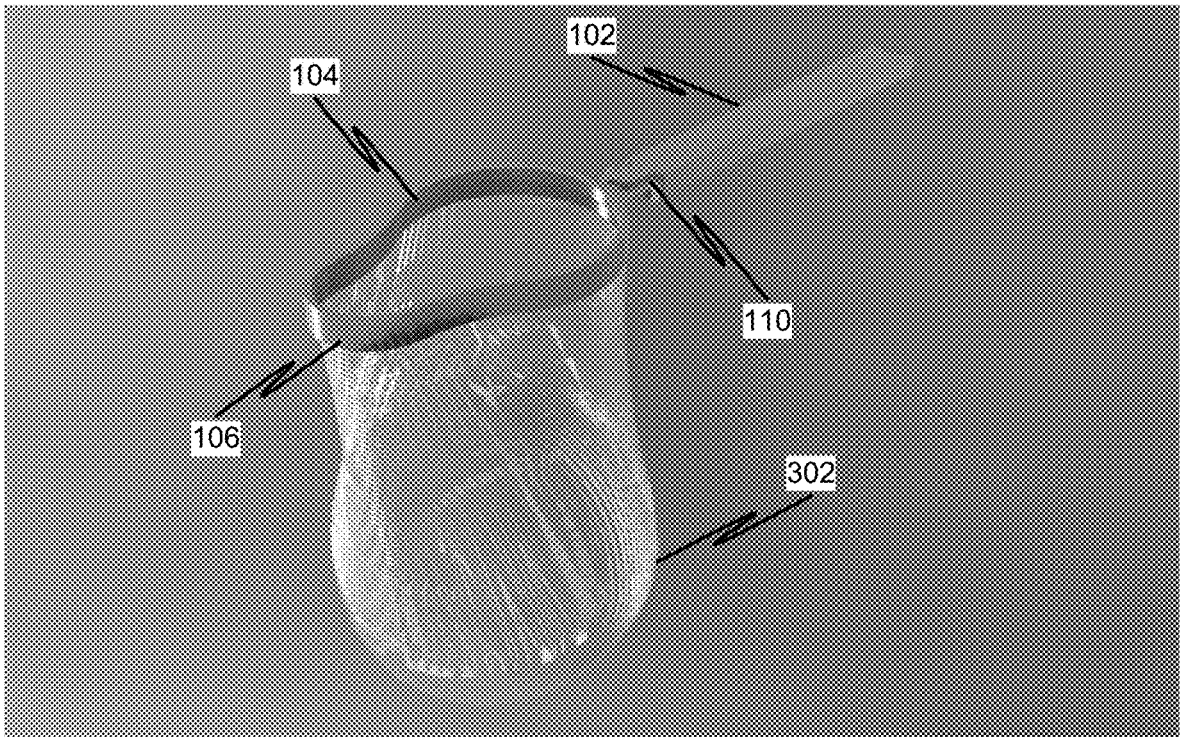
FIG. 3 is a diagram showing a rendering of the example pet waste collection device with a collection bag attached in accordance with some implementations.

FIGS. 1-3 are diagrams showing various views of an example pet waste collection device 100 in accordance with some implementations. The pet waste collection device 100 comprises a handle 102 having a hand grip on a first end and a first hinge portion on a second end. The pet waste collection device 100 also comprises a bag holder 104. The handle 102 can be a single piece as shown or multiple pieces so as to be collapsible or telescopic (e.g., a handle such as that shown in U.S. Pat. No. 7,337,933 or U.S. Pat. No. 10,729,213, which are both incorporated herein by reference, or the like).

The bag holder 104 includes a base 108 including a first rounded end having a first radius and a second rounded end having a second radius, where the second radius is larger than the first radius. The bag holder includes a second hinge portion disposed at the second rounded end of the base configured to engage the first hinge portion of the handle. The bag holder 104 also includes a bag latch 106 coupled to the base via a flexible hinge disposed at the second rounded end of the base.

In operation, the bag holder 104 is configured to retain a bag 302 when the bag is placed within an interior aperture defined by the bag holder 104 and the bag latch 106 is closed over an upper edge of the bag 302 and secured to the base 108.

A hinge can be used to set an angle between the handle 102 and the bag holder 104. The first hinge portion and the second hinge portion are coupled with a fastener 110 (e.g., a bolt, screw, rod, or the like) so as to permit the first hinge portion and the second hinge portion to rotate relative to each other. Any suitable hinge type will work for the hinge.

While some example implementations have been described in terms of a general embodiment with several specific example modifications, it is recognized that other modifications and variations of the embodiments described above are within the spirit and scope of the disclosed subject matter. Applicant intends to embrace any and all such modifications, variations and embodiments.

What is claimed is:

1. A pet waste collection device comprising:

a handle having a hand grip on a first end and a first hinge portion on a second end; and a bag holder having:

a base including a first rounded end having a first radius and a second rounded end having a second radius, where the second radius is larger than the first radius, a second hinge portion disposed at the second rounded end of the base and configured to engage the first hinge portion of the handle, and a bag latch coupled to the base via a flexible hinge disposed at the second rounded end of the base, wherein a hinge formed by the first hinge portion and the second hinge portion permits the handle to be positioned at an angle to the bag holder, wherein the second hinge portion and the base are part of a single plane, and wherein the bag holder is configured to retain a bag when the bag is placed within an interior aperture defined by the bag holder and the bag latch is closed over an upper edge of the bag.

2. The pet waste collection device of claim 1, wherein the first hinge portion and the second hinge portion are coupled with a fastener so as to permit the first hinge portion and the second hinge portion to rotate relative to each other.

3. The pet waste collection device of claim 1, wherein the handle is formed of plastic.

4. The pet waste collection device of claim 1, wherein the bag holder is formed of plastic.

5. The pet waste collection device of claim 1, wherein the handle is formed of metal.

6. The pet waste collection device of claim 1, wherein the bag holder is formed of metal.

* * * * *